US006285273B1

(12) United States Patent
Morikawa

(10) Patent No.: US 6,285,273 B1
(45) **Date of Patent: *Sep. 4, 2001**

(54) LAMINATED BALUN TRANSFORMER

(75) Inventor: Takehiko Morikawa, Takefu (JP)

(73) Assignee: Murata Manufacturing Co., Ltd., Nagaokakyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/815,708

(22) Filed: Mar. 12, 1997

(30) Foreign Application Priority Data

Mar. 22, 1996 (JP) ..... 8-66589

(51) Int. Cl.[7] ..... H01F 5/00
(52) U.S. Cl. ..... 336/200; 336/232; 336/223
(58) Field of Search ..... 333/116, 26; 336/200, 336/232, 223

(56) References Cited

U.S. PATENT DOCUMENTS 3,483,499 * 12/1969 Lugten ..... 336/200
3,833,872 * 9/1974 Marcus et al. ..... 336/232
4,342,143 * 8/1982 Jennings ..... 336/200
5,184,103 * 2/1993 Gadreau et al. ..... 336/200
5,373,112 * 12/1994 Kamimura et al. ..... 336/200
5,386,206 * 1/1995 Iwatani et al. ..... 336/200
5,497,137 * 3/1996 Fujiki ..... 336/200
5,521,573 * 5/1996 I noh et al. ..... 336/200
5,834,992 * 11/1998 Kato et al. ..... 333/185

FOREIGN PATENT DOCUMENTS 5-82350 * 4/1993 (JP) ..... 336/200
5-135968 * 6/1993 (JP) ..... 336/200

* cited by examiner

*Primary Examiner*—Anh Mai
(74) *Attorney, Agent, or Firm*—Burns, Doane, Swecker & Mathis, LLP

(57) ABSTRACT

A laminated balun transformer includes a dielectric sheet for which a lead electrode is provided at its surface, dielectric sheets for which λ/4 striplines are provided at their surfaces respectively, and dielectric sheets for which ground electrodes are provided at their surfaces respectively. One pair of opposing striplines is provided with a dielectric sheet disposed therebetween so as to be electromagnetically coupled. The other pair of opposing striplines is provided with a dielectric sheet disposed therebetween so as to be electromagnetically coupled. An end of a stripline of one pair of striplines is electrically connected to an end of a stripline of the other pair of striplines through an external electrode.

12 Claims, 5 Drawing Sheets

LAMINATED BALUN TRANSFORMER

BACKGROUND OF THE INVENTION

1. Field of the Invention

The present invention relates to laminated balun transformers, and more particularly, to a laminated balun transformer used as a balanced-unbalanced signal converter or phase converter in a radio communication IC chip.

2. Description of the Related Art

A balun transformer converts a balanced signal in a balanced transmission line into an unbalanced signal in an unbalanced transmission line and vice versa. "Balun" is an acronym from BALanced to UNbalanced. A balanced transmission line is provided with a pair of signal paths and a balanced signal transfers, as a voltage difference, between the two signal paths. In a balanced transmission line, since external noise equally affects the two signal paths, the external noise is canceled. Therefore, a balanced transmission line is unsusceptible to external noise. Since a circuit in an analog IC chip is configured with a differential amplifier, input and output terminals for an analog IC chip signal are of a balanced type which input and output signals as voltage differences between the two terminals, in many cases. In contrast, an unbalanced transmission line transfers an unbalanced signal, as a voltage, between one transmission line and the ground (zero voltage). It includes a coaxial line and a microstripline on a substrate.

A balun transformer, in which a winding is wrapped around a magnetic core such as ferrite in a bifilar winding, is conventionally used for a balanced-unbalanced converter in a transmission line of a high-frequency circuit. Such a balun transformer, however, has a large conversion loss in a high-frequency band above the UHF band and is limited as to size reduction.

In such a frequency band, a coaxial balun transformer 51 shown in FIG. 6 is used. The balun transformer 51 has a center electrode 55, one end of the center electrode 55 being connected to an input and output terminal 52*a* and the other end being made open. Around the center electrode 55, two internal electrodes 56*a* and 56*b* are provided so as to electromagnetically couple with the center electrode 55. The other two input and output terminals 52*b* and 52*c* are connected to the internal ends opposing each other of the two internal electrodes 56*a* and 56*b* through leads 57*a* and 57*b*, respectively. A ground electrode 58 is provided around the two internal electrodes 56*a* and 56*b* with a dielectric member disposed therebetween. Both ends of the ground electrode 58 are connected to the external ends of the internal electrodes 56*a* and 56*b*.

Another balun transformer has also been proposed. This balun transformer is a laminated balun transformer 60 shown in FIG. 7. The balun transformer 60 includes a dielectric layer 61*b* on which a lead electrode 62 is provided, a dielectric layer 61*c* on which a λ/2 stripline 63 is provided, a dielectric layer 61*d* on which λ/4 striplines 64 and 65 are provided, and dielectric layers 61*a* and 61*e* on which ground electrodes 66 and 67 are provided, respectively. The λ/4 striplines 64 and 65 are electromagnetically coupled with the left section 63*a* and the right section 63*b* of the λ/2 stripline 63, respectively.

Since the balun transformer 51 of FIG. 6 has a coaxial structure, it is difficult to make it compact. Therefore, it is not suited to units such as mobile radio equipment which require a compact balun transformer.

Although the balun transformer 60 of FIG. 7 is definitely more compact than the balun transformer 51 having the coaxial structure, since the λ/2 stripline 63 is routed on the dielectric layer 61*c*, the balun transformer 60 occupies a large area on a printed circuit board when it is mounted on the printed circuit board.

To adjust the electric characteristics of the balun transformer 60, electromagnetic coupling between striplines is adjusted by changing the thickness of a dielectric layer and the width of a stripline. However, there is no other way but to change the width of the λ/4 stripline 64 or the line width of the left-hand section 63*a* of the λ/2 stripline 63 to, for example, independently adjust electromagnetic coupling between the λ/4 stripline 64 and the left-hand section 63*a* of the λ/2 stripline 63 and electromagnetic coupling between the λ/4 stripline 65 and the right-hand section 63*b* of the λ/2 stripline 63. This is because, when the thickness of the dielectric layer 61*c* disposed between the λ/4 striplines 64 and 65 and the λ/2 stripline 63 is changed, electromagnetic coupling between the λ/4 stripline 65 and the right-hand section 63*b* of the λ/2 stripline 63 is affected. Adjustment by stripline width causes a slight change and it is not easy to adjust electromagnetic coupling between striplines.

SUMMARY OF THE INVENTION

Accordingly, it is an object of the present invention to provide a laminated balun transformer which allows easy adjustment of electromagnetic coupling between striplines and which can be made compact.

The foregoing object is achieved in one aspect of the present invention through the provision of a laminated balun transformer including at least two pairs of striplines each stripline of a pair being electromagnetically coupled through a dielectric layer, the pairs of striplines being separated with a dielectric layer interposed between the pairs in a stacked structure.

The foregoing object is achieved in another aspect of the present invention through the provision of a laminated balun transformer including a first dielectric sheet with a first stripline located at one surface thereof, a second dielectric sheet with a second stripline electromagnetically coupled with the first stripline located at one surface thereof, a third dielectric sheet with a third stripline located at one surface thereof, a fourth dielectric sheet with a fourth stripline electromagnetically coupled with the third stripline located at one surface thereof, and an electrically connection electrically connecting the first stripline and the fourth stripline wherein the first, the second, the third, and the fourth dielectric sheets are in a stacked relationship one above another in a laminated structure. The electrical connecting means includes external electrodes provided on side faces of the laminated member and via holes provided inside the laminated member.

According to the present invention, since at least two pairs of striplines electromagnetically coupled with a dielectric layer disposed therebetween are provided, the two pairs of striplines being stacked through a dielectric layer, each stripline being laminated to a dielectric layer without being disposed on the same dielectric layer as another stripline, and a balun transformer having a small area is obtained. In addition, since the thickness of a dielectric layer sandwiched by one pair of electromagnetically coupled striplines can be adjusted independently of the thickness of the dielectric layer sandwiched by the other pair of striplines, a laminated balun transformer in which electromagnetic coupling between striplines can be easily adjusted is obtained.

DESCRIPTION OF THE PREFERRED EMBODIMENTS

Laminated balun transformers according to embodiments of the present invention will be described below by referring to the accompanying drawings. In each embodiment, the same components and the same portions are assigned the same reference symbols.

First Embodiment

Figure 1:
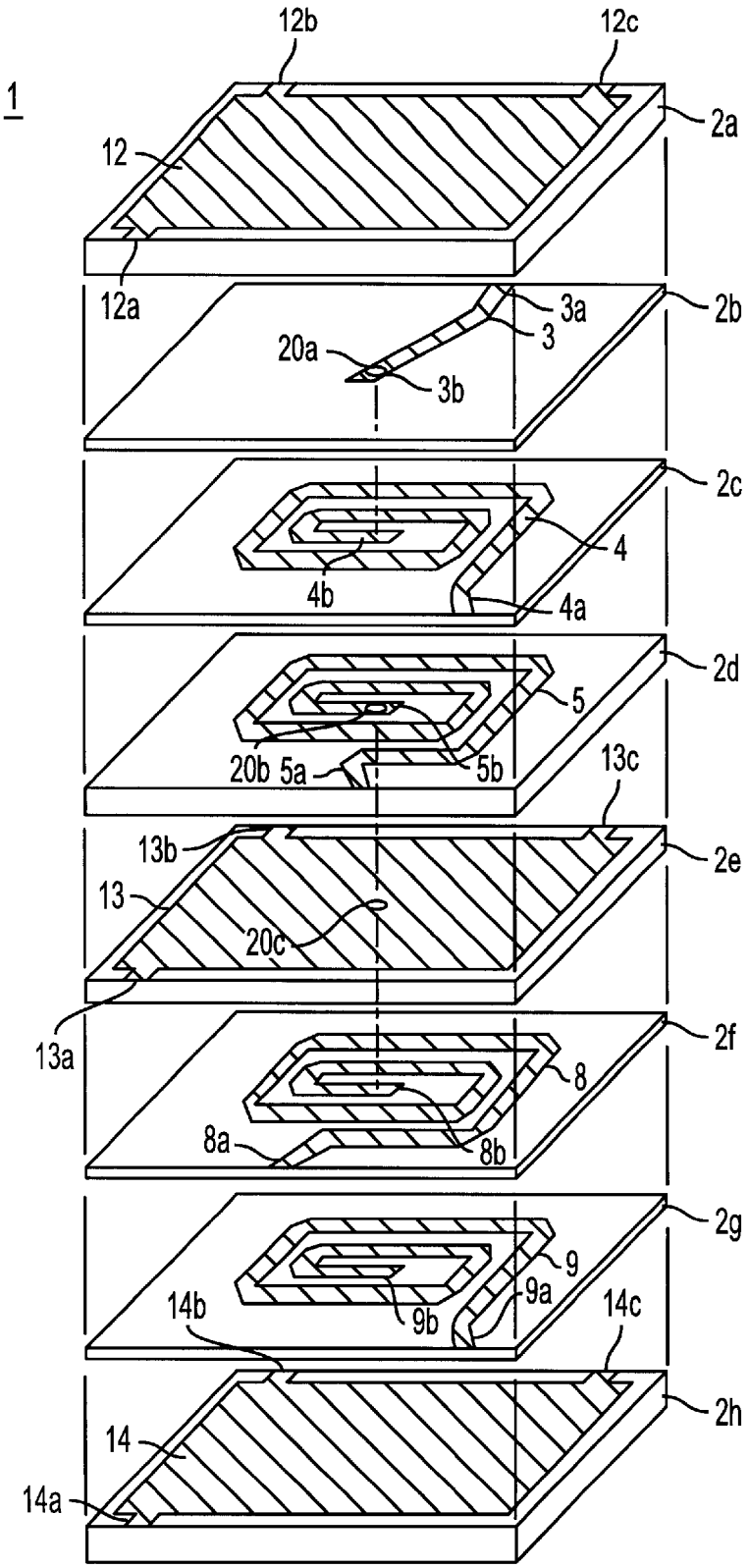
FIG. 1 is an exploded, perspective view of a laminated balun transformer according to a first embodiment of the present invention.

As shown in FIG. 1, a laminated balun transformer 1 includes first through fourth dielectric sheets 2*c*, 2*d*, 2*f*, and 2*g* on which λ/4 striplines 4, 5, 8, and 9 are provided, respectively, and fifth through seventh dielectric sheets 2*a*, 2*e*, and 2*h* on which first through third ground electrodes 12, 13, and 14 are provided, respectively and a eighth dielectric sheet 2*b* on which a lead electrode 3 is provided.

The eight dielectric sheets 2*a* to 2*h* can be made from resin such as epoxy or a ceramic dielectric material. In the first embodiment, dielectric ceramic powder is kneaded with a binder from which the eight dielectric sheets 2*a* to 2*h* are formed.

The lead electrode 3 is formed such that one end 3*a* thereof is exposed slightly right of the center of the far side of the eighth sheet 2*b* as shown in FIG. 1 and the other end 3*b* thereof is disposed at the center of the eighth sheet 2*b*. The first, λ/4 stripline 4 has a spiral shape, one end 4*a* being exposed at the right-hand part of the near side of the first dielectric sheet 2*c* as shown in FIG. 1 and the other end 4*b* being disposed at the center of the first dielectric sheet 2*c*. The centrally disposed end 4*b* of the first stripline 4 is electrically connected to the centrally disposed end 3*b* of the lead electrode 3 through a via hole 20*a* provided in the eighth dielectric sheet 2*b*. The second, λ/4 stripline 5 has a spiral shape, one end 5*a* of which being exposed slightly right of the center of the near side of the second dielectric sheet 2*d* as shown in FIG. 1 and the other end 5*b* being disposed at the center of the second sheet 2*d*. The second stripline 5 is formed so as to oppose the first stripline 4 with the first dielectric sheet 2*c* disposed therebetween. Therefore, the first and second striplines 4 and 5 are electromagnetically coupled to form a first coupler.

The third, λ/4 stripline 8 has a spiral shape, one end 8*a* of which being exposed slightly left of the center of the near side of the third sheet 2*f* and the other end 8*b* of which being disposed at the center of the third sheet 2*f*. The fourth, λ/4 stripline 9 has a spiral shape, one end 9*a* of which being exposed at the right-hand part of the near side of the fourth sheet 2*g* as shown in FIG. 1 and the other end 9*b* of which being open and disposed at the center of the fourth sheet 2*g*. The fourth stripline 9 is formed so as to oppose the third stripline 8 with the third dielectric sheet 2*f* disposed therebetween. Therefore, the third and fourth striplines 8 and 9 are electromagnetically coupled to form a second coupler.

The first ground electrode 12 is provided on almost the entire area of a surface of the fifth sheet 2*a*. A lead section 12*a* of the first ground electrode 12 is exposed at the left-hand part of the near side of the fifth dielectric sheet 2*a*, and lead sections 12*b* and 12*c* are exposed at the left- and right-hand parts of the far side of the fifth sheet 2*a*, respectively. The second ground electrode 13 is provided on almost the entire area of a surface of the sixth dielectric sheet 2*e*. A lead section 13*a* of the second ground electrode 13 is exposed at the left-hand part of the near side of the sixth sheet 2*e*, and lead sections 13*b* and 13*c* are exposed at the left- and right-hand parts of the far side of the sixth sheet 2*e*, respectively, as shown in FIG. 1. The second ground electrode 13 is electrically connected to the end 5*b* of the second stripline 5 through a via hole 20*b* provided in the second sheet 2*d* and electrically connected to the end 8*b* of the third stripline 8 through a via hole 20*c* provided in the sixth sheet 2*e*. The fourth ground electrode 14 is provided on almost the entire area of a surface of the seventh dielectric sheet 2*h*. A lead section 14*a* is exposed at the left-hand part of the near side of the seventh sheet 2*h*, and lead sections 14*b* and 14*c* are exposed at the left- and right-hand parts of the far side of the sheet 2*h*, respectively.

It is preferred that these three ground electrodes 12 to 14 be disposed at positions spaced away from the four striplines 4, 5, 8, and 9 by specified distances with the characteristics of the balun transformer 1 being taken into account. The lead electrode 3, the four striplines 4, 5, 8, and 9, and the three ground electrodes 12 to 14 are made from materials such as AgPd, Ag, Pd, and Cu, and formed by a spattering method, a vapor deposition method, or a printing method, for example.

Figure 2:
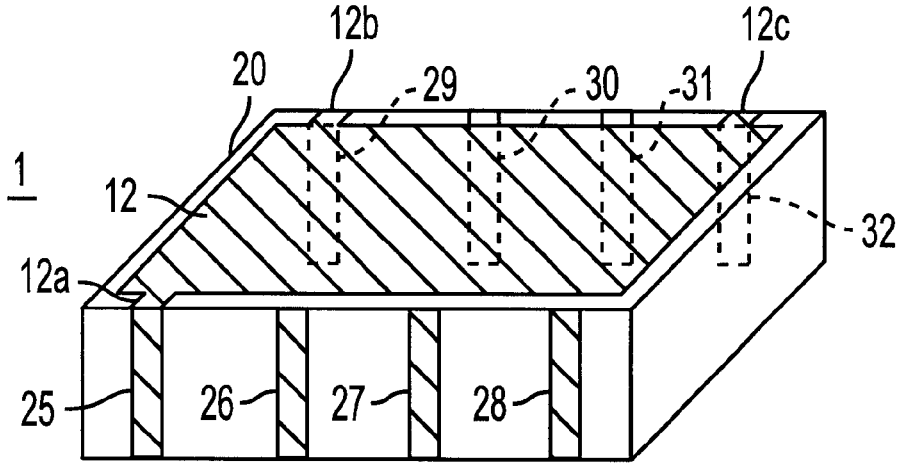
FIG. 2 is a perspective view of the balun transformer shown in FIG. 1.

The eight sheets 2*a* to 2*h* are stacked and sintered integrally to form a laminated member 20 shown in FIG. 2. Four external electrodes 25, 26, 27, and 28 are formed on the near face of the laminated member 20, and four external electrodes 29, 30, 31, and 32 are formed on the far face. All eight external electrodes 25 to 32 are made from materials such as AgPd, Ag, Pd, and Cu, and formed by a spattering method, a vapor deposition method, or a printing method, for example.

Figure 3:
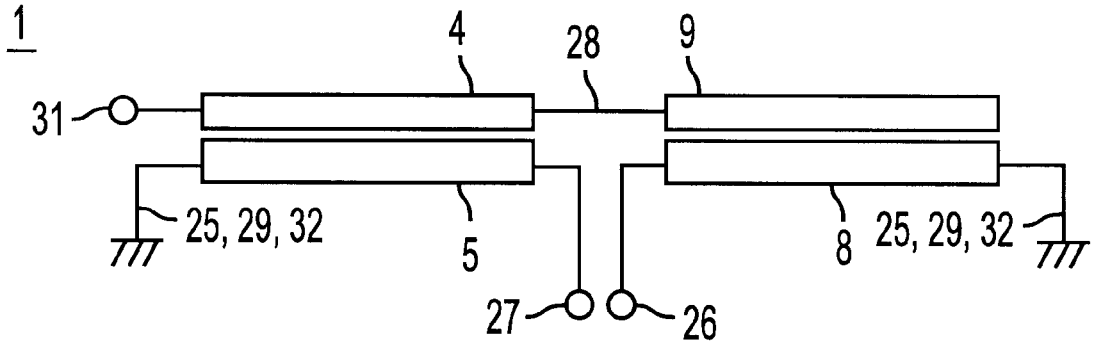
FIG. 3 is an electric equivalent circuit diagram of the balun transformer shown in FIG. 2.
Figure 4:
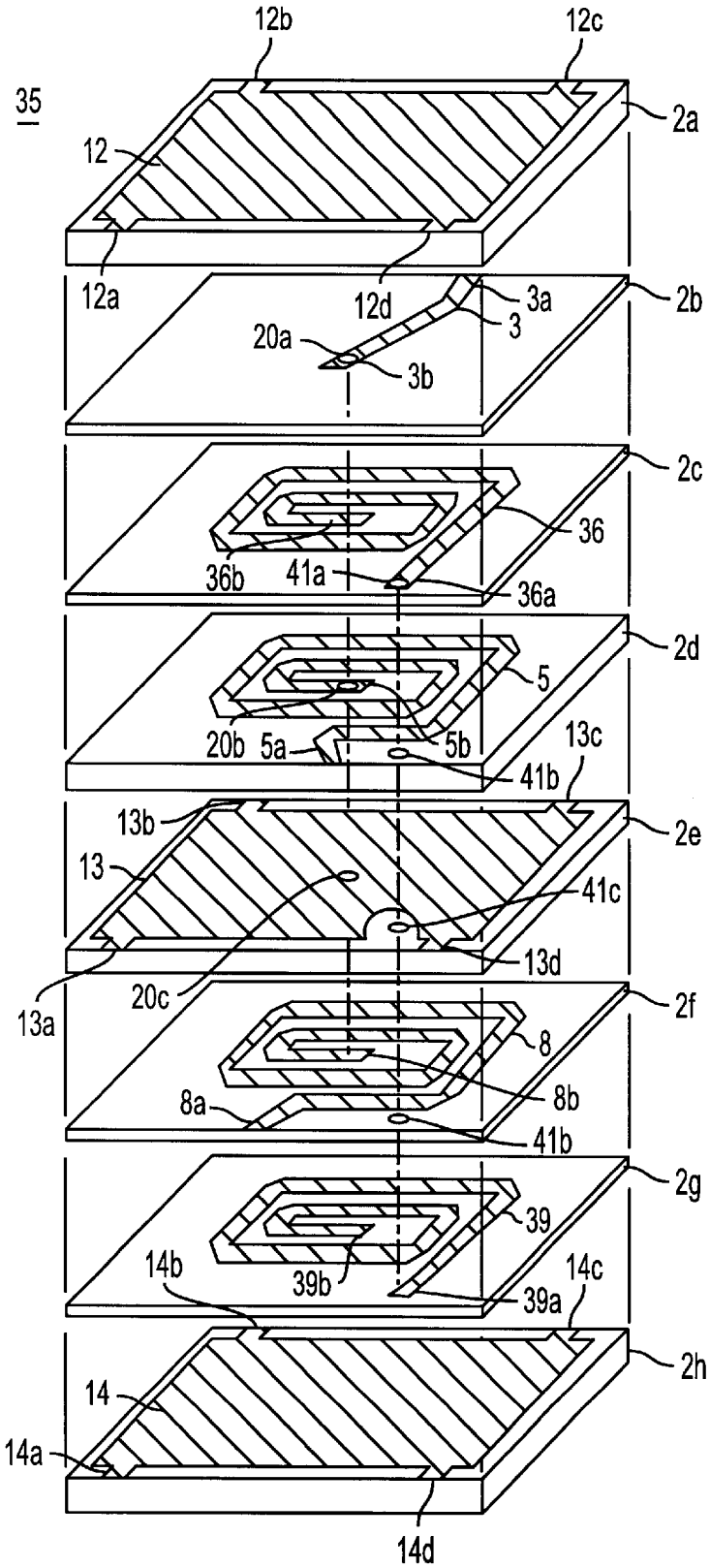
FIG. 4 is an exploded, perspective view of a laminated balun transformer according to a second embodiment of the present invention.

The first external electrode 25 for the ground is electrically connected to the lead sections 12*a*, 13*a*, and 14*a* of the three ground electrodes 12 to 14. The second external electrode 26 for input and output is electrically connected to the end 8*a* of the third stripline 8, and the third external electrode 27 for input and output is electrically connected to the end 5*a* of the second stripline 5. The fourth external electrode 28 for relay is electrically connected to the ends 4*a* and 9*a* of the striplines 4 and 9. The fifth external electrode 29 for the ground is electrically connected to the lead sections 12*b*, 13*b*, and 14*b* of the three ground electrodes 12 to 14. The sixth external electrode 31 for input and output is electrically connected to the end 3*a* of the stripline 3. The seventh external electrode 32 for the ground is electrically connected to the lead sections 12*c*, 13*c*, and 14*c* of the three ground electrodes 12 to 14. The eight electrode 30 is not connected to any lead sections. FIG. 3 is an electric equivalent circuit diagram of the balun transformer 1.

Figure 7:
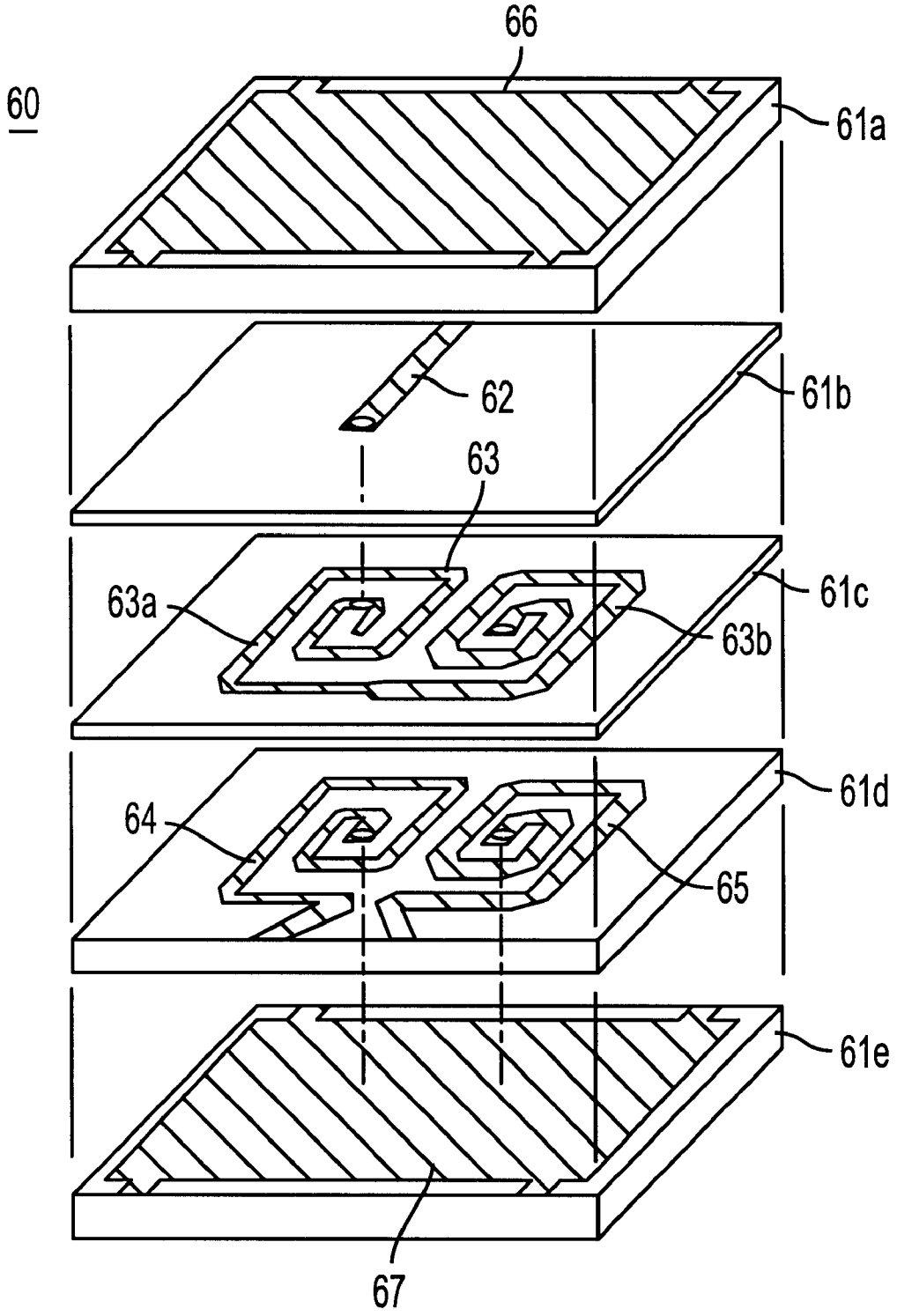
FIG. 7 (PRIOR ART)
FIG. 7 is an exploded, perspective view of another conventional balun transformer.

Since the balun transformer 1 having the configuration described above has the four striplines 4, 5, 8, and 9 which have a length equal to one fourth the wavelength corresponding to the applied center frequency, the dielectric sheets are not required to have a large area. As a result, the balun transformer 1 is made compact. More specifically, the balun transformer 1 requires an area on a printed circuit board about half that of the conventional laminated balun transformer 60 shown in FIG. 7.

To adjust the electric characteristics of the balun transformer 1, the thickness of the first and third dielectric sheets 2*c* and 2*f* and the widths of the four striplines 4, 5, 8, and 9 can be changed to adjust electromagnetic coupling between the first and second striplines 4 and 5 and electromagnetic coupling between the third and fourth striplines 8 and 9. The four striplines 4, 5, 8, and 9 are not formed on the same dielectric sheet. The first and second striplines 4 and 5 are electromagnetically coupled through the first dielectric sheet 2*c*, and the third and fourth striplines 8 and 9 are electromagnetically coupled through the third dielectric sheet 2*f*. Therefore, by changing the thickness of each of the first and third dielectric sheets 2*c* and 2*f*, electromagnetic coupling between the first and second striplines 4 and 5 is adjusted independently of electromagnetic coupling between the third and fourth striplines 8 and 9. As a result, the balun transformer 1 allows easy adjustment of electromagnetic coupling between the striplines.

Since the balun transformer 1 has the ground electrode 12 on the top surface, it is shielded. The ground electrode 12 is exposed at the top surface. It is needless to say that the ground electrode 12 may be entirely covered by another dielectric sheet.

Operation of the balun transformer 1 serving as a balanced-unbalanced signal converter will be described below. To convert an unbalanced signal in an unbalanced transmission line into a balanced signal in a balanced transmission line and vice versa, the unbalanced transmission line is connected to the sixth external electrode 31, and the balanced transmission line is connected to the second and third external electrodes 26 and 27. An unbalanced signal transferring the unbalanced transmission line goes through the sixth external electrode 31, the lead electrode 3, the first stripline 4, the fourth external electrode 28, and the fourth stripline 9. Since the first stripline 4 is electromagnetically coupled with the second stripline 5 and the fourth stripline 9 is electromagnetically coupled with the third stripline 8, the unbalanced signal is converted into a balanced signal. The balanced signal is taken out between two signal paths in the balanced transmission line through the second and third external electrodes 26 and 27. A balanced signal between the two signal paths in the balanced transmission line goes into the balun transformer 1 through the second and third external electrodes 26 and 27 and is converted into an unbalanced signal with the above-described operation being performed in the reverse order. The unbalanced signal is taken out at the unbalanced transmission line through the sixth external electrode 31.

Second Embodiment

A balun transformer according to a second embodiment is the same as the balun transformer 1 according to the first embodiment except that the first and fourth striplines 4 and 9 are electrically connected with via holes instead of an external electrode.

A first, $\lambda/4$ stripline 36 provided on the surface of the first dielectric sheet 2*c* has a spiral shape, one end 36*a* of which being disposed at the right-hand part of the near side of the first sheet 2*c* and the other end 36*b* being disposed at the center of the first sheet 2*c*. A fourth, $\lambda/4$ stripline 39 provided on the fourth dielectric sheet 2*g* on its surface has a spiral shape, one end 39*a* of which being disposed at the right-hand part of the near side of the sheet 2*g* and the other end 39*b* being disposed at the center of the sheet 2*g*.

The first through fourth dielectric sheets 2*c*, 2*d*, 2*e*, and 2*f* are provided with via holes 41*a*, 41*b*, 41*c*, and 41*d*. The near side end 36*a* of the first stripline 36 is electrically connected to the near side end 39*a* of the fourth stripline 39 through these via holes 41*a* to 41*d*.

The first, second and third ground electrodes 12, 13, and 14 are provided with lead sections 12*d*, 13*d*, and 14*d* at the right-hand parts of the near sides of the fifth, sixth and seventh sheets 2*a*, 2*e*, and 2*h*, respectively, in addition to the lead sections 12*a*, 12*b*, 12*c*, 13*a*, 13*b*, 13*c*, 14*a*, 14*b*, and 14*c* of the three ground electrodes 12, 13, and 14.

Figure 5:
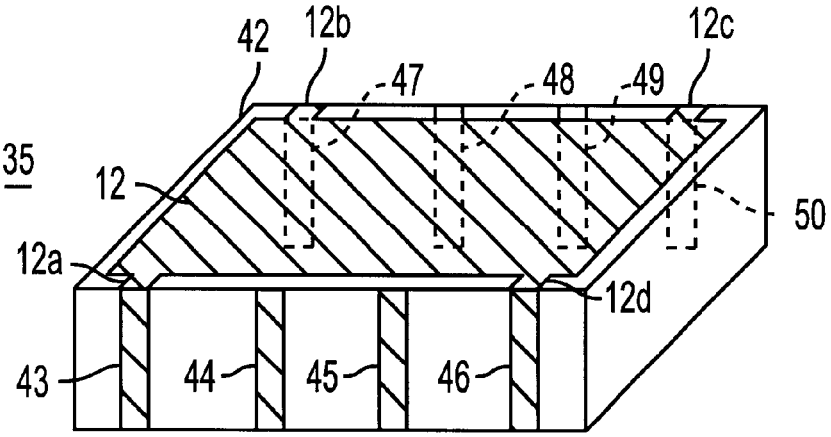
FIG. 5 is a perspective view of the balun transformer shown in FIG. 4.
Figure 6:
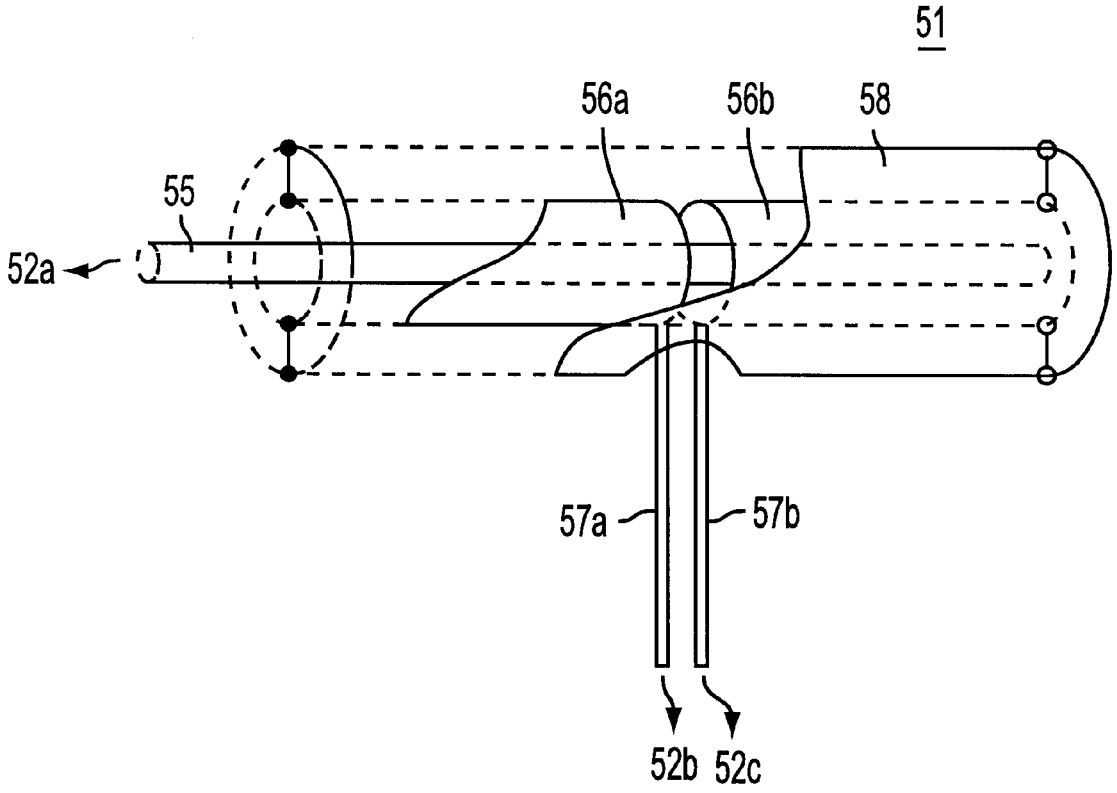
FIG. 6 (PRIOR ART)
FIG. 6 is a partially-broken perspective view of a conventional balun transformer.

The eight sheets 2*a* to 2*h* are stacked and sintered integrally to form a laminated member 42 shown in FIG. 5. Four external electrodes 43, 44, 45, and 46 are formed on the near face of the laminated member 42, and four external electrodes 47, 48, 49, and 50 are formed on the far face.

The first external electrode 43 for the ground is electrically connected to the lead sections 12*a*, 13*a*, and 14*a* of the three ground electrodes 12 to 14. The second external electrode 44 for input and output is electrically connected to the end 8*a* of the third stripline 8, and the third external electrode 45 for input and output is electrically connected to the end 5*a* of the second stripline 5. The fourth external electrode 46 for the ground is electrically connected to the lead sections 12*d*, 13*d*, and 14*d* of the three ground electrodes 12 to 14. The fifth external electrode 47 for the ground is electrically connected to the lead sections 12*b*, 13*b*, and 14*b* of the three ground electrodes 12 to 14. The sixth external electrode 49 for input and output is electrically connected to the end 3*a* of the lead line 3. The sixth external electrode 50 for the ground is electrically connected to the lead sections 12*c*, 13*c*, and 14*c* of the three ground electrodes 12 to 14. The balun transformer 35 having the above-described structure has the same advantages as the balun transformer 1 according to the first embodiment.

A balun transformer according to the present invention is not limited to those described in the above embodiments and can be modified in various ways within the scope of the present invention.

The striplines may have any shape other than a spiral, such as a meander. The striplines may have lengths other than $\lambda/4$. It is not necessary for all the striplines to have the same line width.

The above embodiments describe a case in which balun transformers according to the present invention are made one by one. When they are mass produced, a mother board provided with a plurality of balun transformers is prepared which is divided into the desired size to make products.

In the above embodiments, the dielectric sheets in which the conductive members are formed are stacked and sintered integrally. Production is not limited to this method. Sheets which have been sintered in advance may be used. A balun transformer according to the present invention may be manufactured by the following method. A dielectric layer is formed by applying a paste-form dielectric material by printing or other means and a paste-form electrically conductive material is then applied to the dielectric layer to form a conductive member. A paste-form dielectric material is then applied to the conductor. With overlaying applications in this order, a balun transformer having a laminated structure is obtained.

The present invention has been described by way of exemplary embodiments to which it is not limited. Modifications and variations will be envisioned by those skilled in the art which are within the scope and spirit of the present invention as recited in the claims appended hereto.

What is claimed is:

1. A laminated balun transformer comprising at least two pairs of striplines, the striplines of each pair being exclusively electromagnetically coupled to one another through a respective dielectric layer, the two pairs of striplines being in parallel planes with respect to one another, and with another dielectric layer having a grounded electrode thereon interposed between said pairs of striplines.

2. A laminated balun transformer according to claim 1, further comprising an external grounded electrode connected to said grounded electrode interposed between said pairs of striplines, wherein said external grounded electrode is disposed on a surface of laminated balun transformer, and wherein one stripline from each of said two pairs of striplines is connected to said external grounded electrode via the grounded electrode.

3. A laminated balun transformer comprising:

a first dielectric sheet with a first stripline located at one surface thereof;

a second dielectric sheet with a second stripline exclusively electromagnetically coupled with said first stripline located at one surface thereof;

a third dielectric sheet with a first grounded electrode located at one surface thereof:

a fourth dielectric sheet with a third stripline located at one surface thereof;

a fifth dielectric sheet with a fourth stripline exclusively electromagnetically coupled with said third stripline located at one surface thereof; and electrically connecting means for electrically connecting said first stripline and said fourth stripline, wherein said first, said second, said third, said fourth, and fifth dielectric sheets are in a stacked relationship one above another in a laminated structure.

4. A laminated balun transformer according to claim 3, further comprising:

a sixth dielectric sheet with a second ground electrode located at one surface thereof;

and a seventh dielectric sheet with a third ground electrode located at one surface thereof, wherein said sixth, said first, said second, said third, said fourth, said fifth, and said seventh dielectric sheets are in a stacked relationship one above another in a laminated structure.

5. A laminated balun transformer according to claim 4, further comprising an eighth dielectric sheet with a lead electrode located at one surface thereof, wherein said eighth, said sixth, said first, said second, said sixth, said third, said fourth, said fifth, and said seventh dielectric sheets are in a stacked relationship one above another in a laminated structure.

6. A laminated transformer in accordance with claim 3, wherein said electrical connecting means includes via holes provided inside the laminated structure.

7. A laminated transformer in accordance with claim 3, wherein said striplines are spiral shaped.

8. A laminated transformer in accordance with claim 3, wherein said electrical connecting means includes external electrodes provided on side faces of the laminated structure.

9. A laminated balun transformer according to claim 3, further comprising an external grounded electrode connected to said grounded electrode interposed between said second and third striplines, wherein said external grounded electrode is disposed on a surface of laminated balun transformer, and wherein said second and third striplines are connected to said external grounded electrode via the grounded electrode.

10. A laminated balun transformer used for a balanced-unbalanced circuit for taking out balanced signals from unbalanced signals or unbalanced signals from balanced signals, comprising at least two pairs of striplines, the striplines of each pair being exclusively electromagnetically coupled to one another through a respective dielectric layer, the two pairs of striplines being in parallel planes with respect to one another, and with another dielectric layer having a grounded electrode thereon interposed between said pairs of striplines.

11. A laminated balun transformer according to claim 10, wherein said grounded electrode includes a first, second and third grounded electrode, one pair of striplines is disposed between said first grounded electrode and said second ground electrode and the other pair of striplines is disposed between said first grounded electrode and the third electrode.

12. A laminated balun transformer according to claim 10, further comprising an external grounded electrode connected to said grounded electrode interposed between said pairs of striplines, wherein said external grounded electrode is disposed on a surface of laminated balun transformer, and wherein one stripline from each of said at least two pairs of striplines is connected to said external grounded electrode via the ground electrode.

* * * * *